US008864350B2

(12) United States Patent
Okubo et al.

(10) Patent No.: US 8,864,350 B2
(45) Date of Patent: Oct. 21, 2014

(54) VEHICLE HEADLAMP

(75) Inventors: Yasuhiro Okubo, Isehara (JP); Toshiya Abe, Isehara (JP); Kei Onoma, Isehara (JP); Atsushi Igari, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 13/553,207

(22) Filed: Jul. 19, 2012

(65) Prior Publication Data

US 2013/0027957 A1 Jan. 31, 2013

(30) Foreign Application Priority Data

Jul. 26, 2011 (JP) ..... 2011-163674

(51) Int. Cl.
*F21V 13/10* (2006.01)
*F21S 8/10* (2006.01)

(52) U.S. Cl.
CPC ..... *F21S 48/1159* (2013.01); *F21S 48/1784* (2013.01); *F21S 48/137* (2013.01)
USPC ..... 362/512; 362/519

(58) Field of Classification Search
USPC ..... 362/512, 519
See application file for complete search history.

(56) References Cited

U.S. PATENT DOCUMENTS

2010/0165654 A1 7/2010 Okubo et al.
2010/0194276 A1* 8/2010 Okubo et al. ..... 315/82

FOREIGN PATENT DOCUMENTS

| | | | |
|---|---|---|---|
| DE | 20 2010 003 058 | U1 | 6/2010 |
| EP | 1 970 617 | B1 | 9/2008 |
| EP | 2 028 411 | B1 | 2/2009 |
| EP | 2 143 994 | A1 | 1/2010 |
| EP | 2 282 110 | A2 | 2/2011 |
| EP | 2 405 191 | A1 | 1/2012 |
| JP | 2007-194166 | A | 8/2007 |
| JP | 2010-018178 | A | 1/2010 |

OTHER PUBLICATIONS

Y. Okubo, U.S. PTO Official Action, U.S. Appl. No. 13/553,232, dated Apr. 15, 2014, 8 pages.

* cited by examiner

*Primary Examiner* — Anh Mai
*Assistant Examiner* — Brenitra M Lee
(74) *Attorney, Agent, or Firm* — Foley & Lardner LLP

(57) ABSTRACT

The present invention is provided with a first lamp unit 4 and a second lamp unit 5. The first lamp unit 4 is provided with a semiconductor-type light source 14, a reflector 15, a shade 16, and a driving mechanism 17. The reflector 15 has a first reflection surface 21 and a second reflection surface 22. The first reflection surface 21 is adapted to emit lateral light distribution patterns CPL and CPR. The second reflection surface 22 is adapted to emit a light distribution pattern HP for high beam. As a result, according to the present invention, it becomes possible to obtain an arbitrary auxiliary light distribution pattern, such as a light distortion pattern for spot or a light distribution pattern for scattering other than the lateral light distribution patterns CPL and CPR.

6 Claims, 10 Drawing Sheets

VEHICLE HEADLAMP

CROSS-REFERENCE TO RELATED APPLICATIONS

This application claims priority of Japanese Patent Application No. 2011-163674 filed on Jul. 26, 2011. The contents of this application are incorporated herein by reference in their entirety.

BACKGROUND OF THE INVENTION

1. Field of the Invention

The present invention relates to a vehicle headlamp that is provided with: a first lamp unit adapted to switch and emit an auxiliary light distribution pattern and a light distribution pattern for high beam (for cruising); and a second lamp unit adapted to emit a light distribution pattern for low beam (for passing).

2. Description of the Related Art

A vehicle headlamp of such type is conventionally known (for example, Japanese Unexamined Patent Application Publication No. 2010-018178). Hereinafter, a conventional vehicle headlamp will be described. The conventional vehicle headlamp is provide with: a light source unit adapted to switch and emit a light distribution pattern for DTL and a light distribution pattern for cruising by means of a switch of a scattering lens; and a light source unit adapted to emit a light distribution pattern for passing. The conventional vehicle headlamp is also a headlamp for emitting light from a light emitting element of a light source as a light distribution pattern for cruising without passing through a scattering lens, by means of a switch of the scattering lens, and then, emitting the light from the light emitting element of the light source as the light distribution pattern for DTL that is obtained by scattering the light distribution pattern for cruising in a state in which the pattern is passed through the scattering lens.

In the conventional vehicle headlamp, however, only the light distribution pattern for DTL (the auxiliary light distribution pattern) can be obtained in a state in which the light distribution pattern for cruising is scattered.

The present invention has been made in order to solve the above described problem that in the conventional vehicle headlamp, only the light distribution pattern for DTL (the auxiliary light distribution pattern) can be obtained in a state in which the light distribution pattern for cruising is scattered.

SUMMARY OF THE INVENTION

A vehicle headlamp according to a first aspect of the present invention comprising:

a first lamp unit adapted to switch and emit an auxiliary light distribution pattern and a light distribution pattern for high beam; and a second lamp unit adapted to emit a light distribution pattern for low beam, wherein the first lamp unit comprises:

a semiconductor-type light source;

a reflector having a first reflection surface and a second reflection surface;

a shade that is disposed to be movable between a first location and a second location, and that is adapted to shade a fraction of light from the semiconductor-type light source and to cause residual light to be incident to the first reflection surface, when the shade is positioned in the first location, and cause the light from the semiconductor-type light source to be incident to the first reflection surface and the second reflection surface, when the shade is positioned in the second location; and a driving mechanism adapted to move and switch the shade between the first location and the second location, wherein the first reflection surface is a reflection surface that is provided in proximity to the semiconductor-type light source, the reflection surface being adapted to reflect and emit incident light from among beams of the light from the semiconductor-type light source as the auxiliary light distribution pattern, and the second reflection surface is a reflection surface that is provided outside of the first reflection surface in such a manner as to be spaced from the semiconductor-type light source, the reflection surface being adapted to reflect and emit incident light from among beams of the light from the semiconductor-type light source as the light distribution pattern for high beam.

The vehicle headlamp according to a second aspect of the present invention, wherein a third reflection surface is provided between the first reflection surface and the second reflection surface, and the third reflection surface is a reflection surface that is adapted to reflect and emit incident light from the light from among beams of the semiconductor-type light source as an auxiliary light distribution pattern other than the auxiliary light distribution pattern.

The vehicle headlamp according to a third aspect of the present invention, wherein as far as the first reflection surface is concerned, the first reflection surface outside of a vehicle is positioned at a back side with respect to the first reflection surface inside of the vehicle.

The vehicle headlamp according to a fourth aspect of the present invention, wherein the auxiliary light distribution pattern that is emitted from the first reflection surface of the first lamp unit that is equipped on a left side of a front portion of a vehicle is a lateral light distribution pattern that is emitted to a left side of the light distribution pattern for high beam that is emitted from the second reflection surface and to a left side of a light distribution pattern for low beam that is emitted from the second lamp unit, and the auxiliary light distribution pattern that is emitted from the first reflection surface of the first lamp unit that is equipped on a right side of the front portion of the vehicle is a lateral light distribution pattern that is emitted to a right side of the light distribution pattern for high beam that is emitted from the second reflection surface and to a right side of a light distribution pattern for low beam that is emitted from the second lamp unit.

A vehicle headlamp according to a first aspect of the present invention is provided for emitting an auxiliary light distribution pattern on a first reflection surface of a first lamp unit and then emitting a light distribution pattern for high beam on a second reflection surface; and therefore, in comparison with the conventional vehicle headlamp in which only the light distribution pattern (the auxiliary light distribution pattern) can be obtained in a state in which the light distribution pattern for cruising is scattered, an arbitrary auxiliary light distribution pattern can be obtained by way of a design of the first reflection surface. For example, an arbitrary auxiliary light distribution pattern such as a lateral light distribution patter, a light distribution pattern for spot, or a light distribution pattern for scattering can be obtained. Moreover, the vehicle headlamp according to the first aspect of the present invention is capable of emitting an auxiliary light distribution pattern to thereby effectively utilize a first lamp unit of a light distribution pattern for high beam that is not always emitted.

A vehicle headlamp according to a second aspect of the present invention is provided for emitting an auxiliary light distribution pattern other than the auxiliary light distribution pattern that is obtained by the first reflection surface, on a third reflection surface between the first reflection surface and the second reflection surface; and therefore, a plurality of auxiliary light distribution patterns can be obtained. As a result, the vehicle headlamp according to the second aspect of the present invention improves a degree of freedom in light distribution design of the auxiliary light distribution pattern.

Moreover, the vehicle headlamp according to the second aspect of the present invention is provided in such a manner that the third reflection surface is provided between the first reflection surface and the second reflection surface; and therefore, in a case where an allowable tolerance is set in precision of a stop position of a shade, when the shade is positioned in a first location, even if light from a semiconductor-type light source leaks from the first reflection surface side to the second reflection surface side, the light leakage can be effectively utilized as a predetermined auxiliary light distribution pattern by means of a third reflection surface for buffering (for light buffering) that is provided between the first reflection surface and the second reflection surface. In other words, in the vehicle headlamp according to the second aspect of the present invention, when the shade is positioned in the first location, even if the light from the semiconductor-type light source, the light having leaked due to displacement of the shade, is incident to the second reflection surface as it is, it is possible to reliably prevent the incident light from being troublesome light at the time of emission of a light distribution pattern for low beam.

A vehicle headlamp according to a third aspect of the present invention is provided in such a manner that, as far as the first reflection surface is concerned, a first reflection surface outside of a vehicle is positioned at a back side with respect to a first reflection surface inside of the vehicle, thus making it easy to optically distributing an auxiliary light distribution pattern that is obtained by means of the first reflection surface in such a manner as to be turned lateral of a light distribution pattern for low beam or a light distribution pattern for high beam. As a result, the vehicle headlamp according to the third aspect of the present invention is optimal for a lateral light distribution pattern that is to be optically distributed by turning the auxiliary light distribution pattern that is obtained by means of the first reflection surface, lateral of the light distribution pattern for low beam or the light distribution pattern for high beam, and moreover, a light distribution design of the lateral light distribution pattern is facilitated.

A vehicle headlamp according to a fourth aspect of the present invention is provided in such a manner that: a lateral light distribution pattern from a first lamp unit that is equipped on the left side of a front portion of a vehicle is emitted to the left side of a light distribution pattern for high beam and to the left side of a light distribution pattern for low beam; and a lateral light distribution pattern from a first lamp unit that is equipped on the right side of the front portion of the vehicle is emitted to the right side of the light distribution pattern for high beam and to the right side of the light distribution pattern for low beam. As a result, the vehicle headlamp according to the fourth aspect of the present invention is capable of emitting the lateral light distribution patterns on both of the left and right sides without being shaded by the parts of the vehicle headlamp or the parts of the vehicle or the like, thus making it possible to effectively utilize the light that is radiated from a semiconductor-type light source.

DESCRIPTION OF THE PREFERRED EMBODIMENTS

Figure 1:
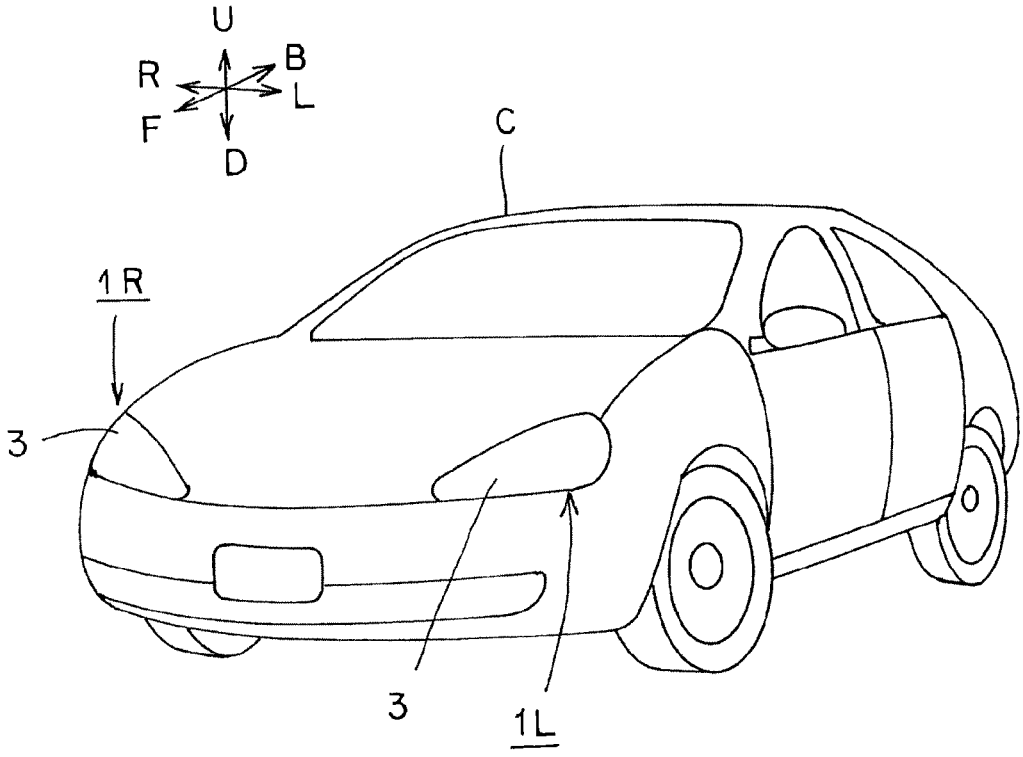
FIG. 1 shows a first embodiment of a vehicle headlamp according to the present invention, and is a perspective view of a vehicle on which the vehicle headlamp according to the first embodiment of the present invention is mounted.
Figure 2:
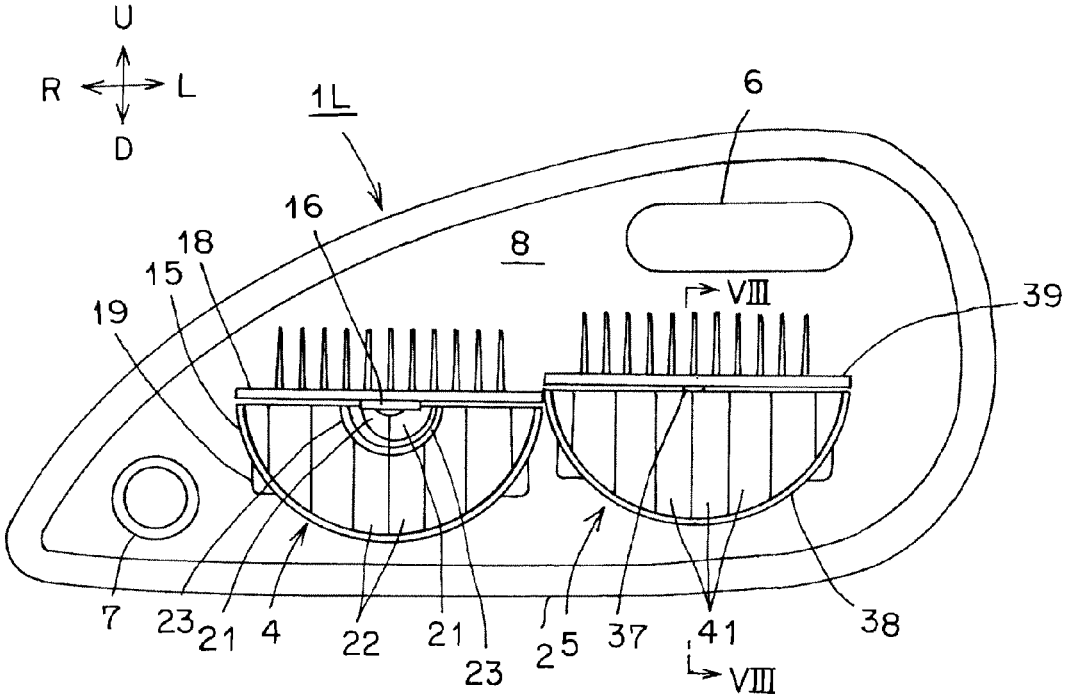
FIG. 2 is a front view showing a vehicle headlamp in a state in which a lamp lens is removed.
Figure 3:
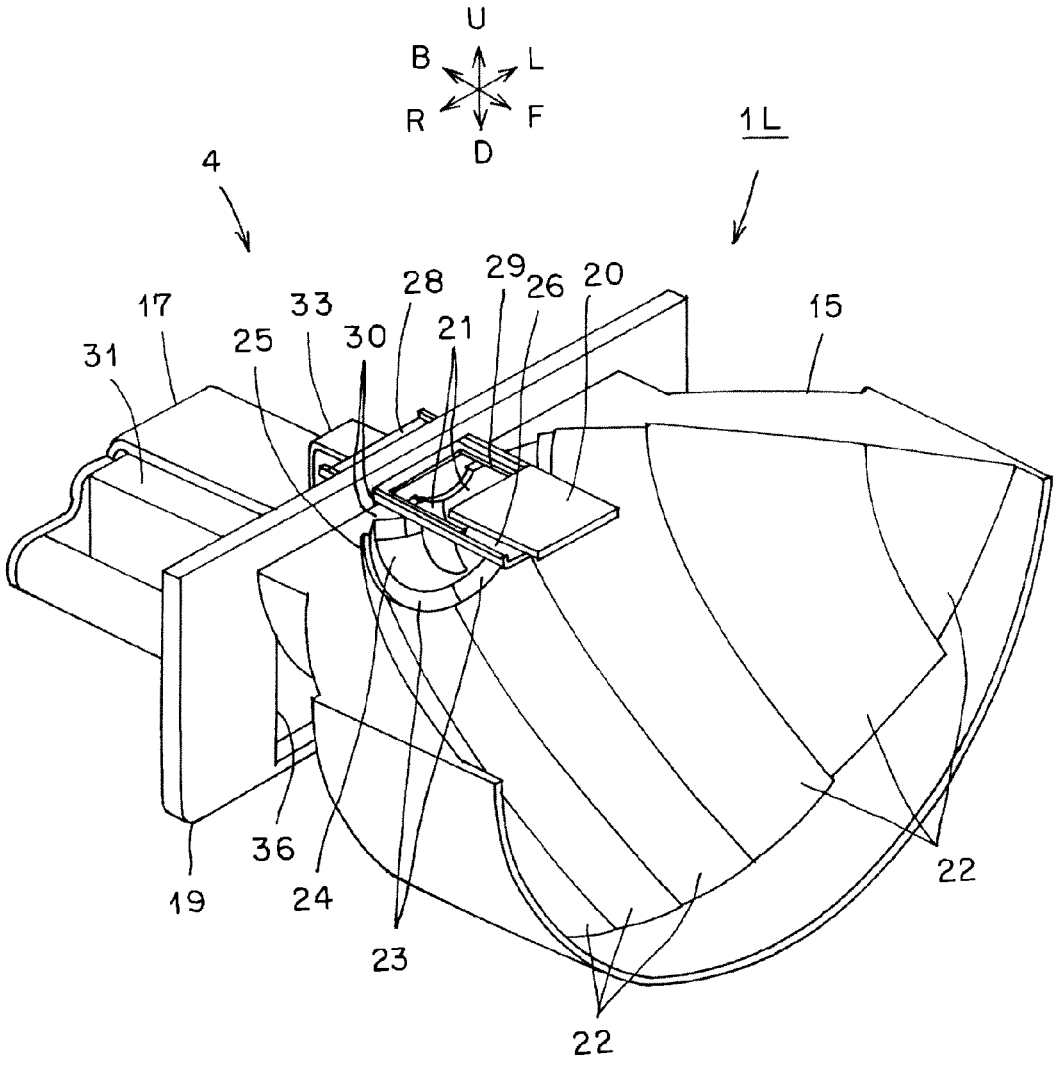
FIG. 3 is a perspective view showing a first lamp unit in a state in which a heat sink is removed.

Two of the embodiments (and examples) of a vehicle headlamp according to the present invention will be described in detail with reference to the drawings. It is to be noted that the present invention is not limited by these embodiments. In the drawings, an uppercase letter F designates a front side of a vehicle C (a forward direction side or a front side of the vehicle C). An uppercase letter B designates a back side (a backward side) of the vehicle C. An uppercase letter U designates an upside (an upward side) when the front side is seen from a driver side. An uppercase letter D designates a downside (a downward side) when the front side is seen from the driver side. An uppercase letter L designates a left side in a case where the front side is seen from the driver side. An uppercase letter R designates a right side in a case where the front side is seen from the driver side. The front side, the back side, the upside, the downside, the left side, the and right side mentioned previously correspond to the front side, the back side, the upside, the downside, the left side, and the right side, respectively, as viewed in a state in which the vehicle headlamp according to the present invention is mounted on a vehicle. In addition, an uppercase letter string with hyphen VD-VD designates a vertical line from the top to the bottom of a screen. An uppercase letter string with hyphen HL-HR designates a horizontal line from left to right of the screen.

Description of Configuration of First Embodiment

Each of FIG. 1 to FIG. 11 shows a first embodiment of a vehicle headlamp according to the present invention. Hereinafter, a configuration of the vehicle headlamp in the first embodiment will be described. In the figures, reference numerals with uppercase letters 1L and 1R each designate a vehicle headlamp (such as a headlamp, for example) in the exemplary embodiment. The vehicle headlamps 1L and 1R, as shown in FIG. 1 are mounted on both of the left and right end parts of a front portion of a vehicle C. Hereinafter, the vehicle headlamp 1L that is to be mounted on a left side L of the vehicle C will be described. It is to be noted that a configuration of the vehicle headlamp 1R that is to be mounted on a right side R of the vehicle C is reversed at the left and right from a configuration of the vehicle headlamp 1L that is to be mounted on the left side L of the vehicle C.

The vehicle headlamp 1L is provided with: a lamp housing 2; a lamp lens 3; a first lamp unit 4; a second lamp unit 5; a third lamp unit 6; and a fourth lamp unit 7.

The lamp housing 3 and the lamp lens 3 define a lamp room 8. In the lamp room 8, the first lamp unit 4, the second lamp unit 5, the third lamp unit 6, and the fourth lamp unit 7 are disposed. The first lamp unit 4 and the second lamp unit 5 are mounted on the lamp housing 2 via an optical axis adjustment mechanism for vertical direction (not shown) and an optical axis adjustment mechanism for horizontal direction (not shown). With respect to the second lamp unit 5, the first lamp unit 4 is disposed inside of the vehicle C (on the right side R in the case of the vehicle headlamp 1L that is to be mounted on the left side L of the vehicle C or on the left side L in the case of the vehicle headlamp 1R that is to be mounted on the right side R of the vehicle C).

Figure 9:
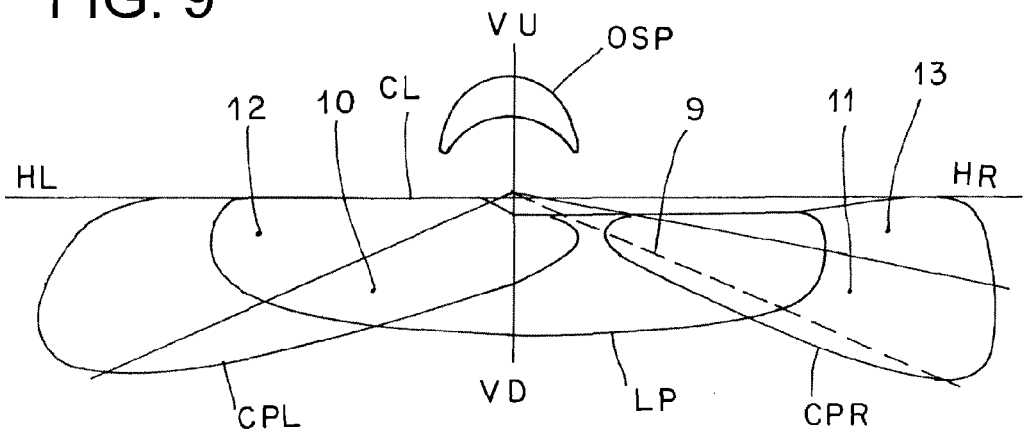
FIG. 9 is an explanatory view showing a light distribution pattern for low beam, a lateral light distribution pattern on a respective one of the left and right sides, and a light distribution pattern for overhead sign.
Figure 10:
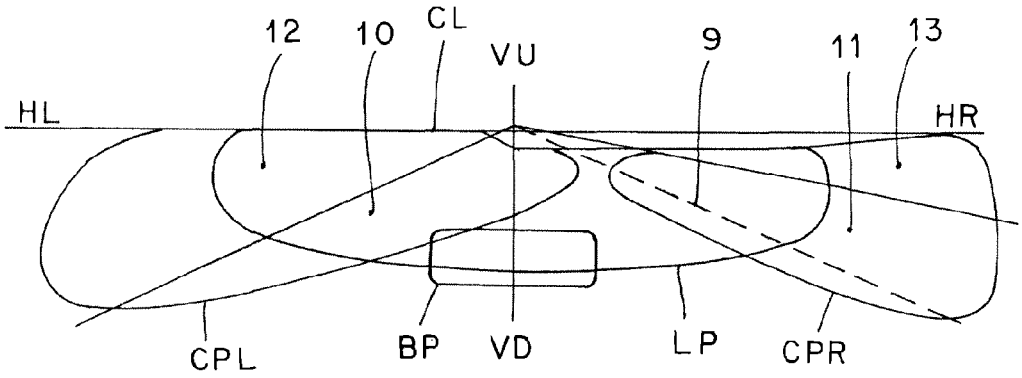
FIG. 10 is an explanatory view showing a light distribution pattern for low beam, a light distribution pattern on a respective one of the left and right sides, and a light distribution pattern for front side.
Figure 11:
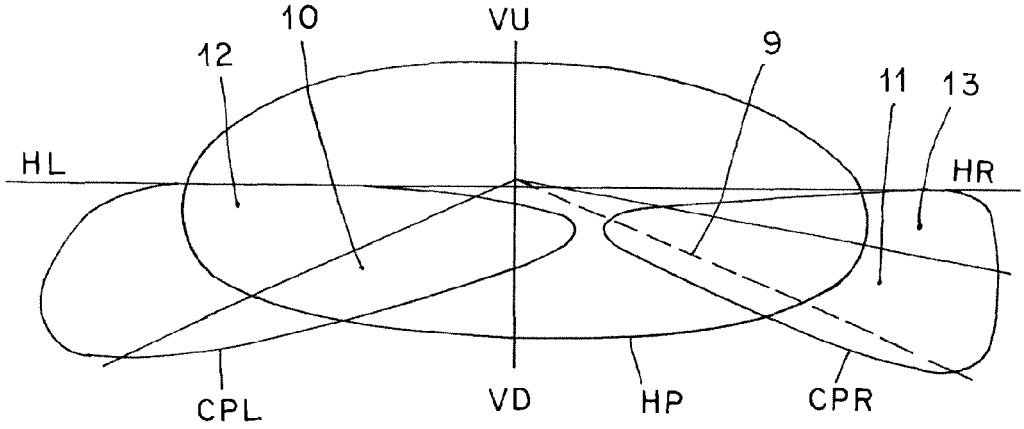
FIG. 11 is an explanatory view showing a light distribution pattern for high beam and a lateral light distribution pattern on a respective one of the left and right sides.

The first lamp unit 4, as shown in FIG. 9 to FIG. 11, is a lamp unit adapted to emit a lateral light distribution pattern for left side CPL, a lateral light distribution pattern for right side CPR, a light distribution pattern for high beam HP, a light distribution pattern for head sign OSP, or a light distribution pattern for front side BP to a front side (forward) of the vehicle C. The second lamp unit 5, as shown in FIG. 9 and FIG. 10, is a lamp unit adapted to emit a light distribution pattern for low beam LP to the front side F (forward) of the vehicle C. The third lamp unit 6 is a lamp unit of a clearance lamp. The fourth lamp unit 7 is a lamp unit of a turn signal lamp.

In FIG. 9 to FIG. 11, reference numeral 9 designates a centerline of a road surface; reference numeral 10 designates a cruising lane of a driver's vehicle on a road surface; reference numeral 11 designates an opposite lane; reference numeral 12 designates a shoulder edge of a road surface on a cruising lane side; and reference numeral 13 designates a shoulder edge of a road surface on an opposite lane side.

The first lamp unit 4, as shown in FIG. 3 to FIG. 6, is provided with: a semiconductor-type light source 14; a reflector 15; a shade 16; a driving mechanism 17; a heat sink member 18; and a mount bracket 19.

The semiconductor-type light source 14, in this example, uses a light source of one's own light emitting semiconductor-type such as an LED or an EL (an organic EL) or the like, for example, in other words, a semiconductor-type light source (an LED in this exemplary embodiment). The semiconductor-type light source 14 has a light emitting portion in which one or a plurality of light emitting chips (not shown) is provided. The semiconductor-type light source 14 is made of: a board (not shown); the light emitting chips that are appropriately disposed and provided on the board; and a sealing resin member (not shown) adapted to seal the light emitting chips. The semiconductor light source 14 is mounted on the heat sink 18 by means of a mount member 20. A light emitting surface of the light emitting portion of the semiconductor light source 14 is oriented to the downside D in a vertical direction.

The reflector 15 is made of a light non-transmissible member, in this example, a resin member. The reflector 15 is mounted on at least one of the head sink member 18 and the mount bracket 19. The reflector 15 opens at a portion of the upside U and the front side F, and closes at other portions.

A first reflection surface 21, a second reflection surface 22, and a third reflection surface 23 that are made of a parabola-based free curved surface (NURBS-curved surface) are respectively provided on an interior face of the closed portion of the reflector 15. The first reflection surface 21, the second reflection surface 22, and the third reflection surface 23 are respectively provided at an opposite side to the light emitting surface, in other words, in a space of the downside D of the semiconductor-type light source 14.

Figure 7:
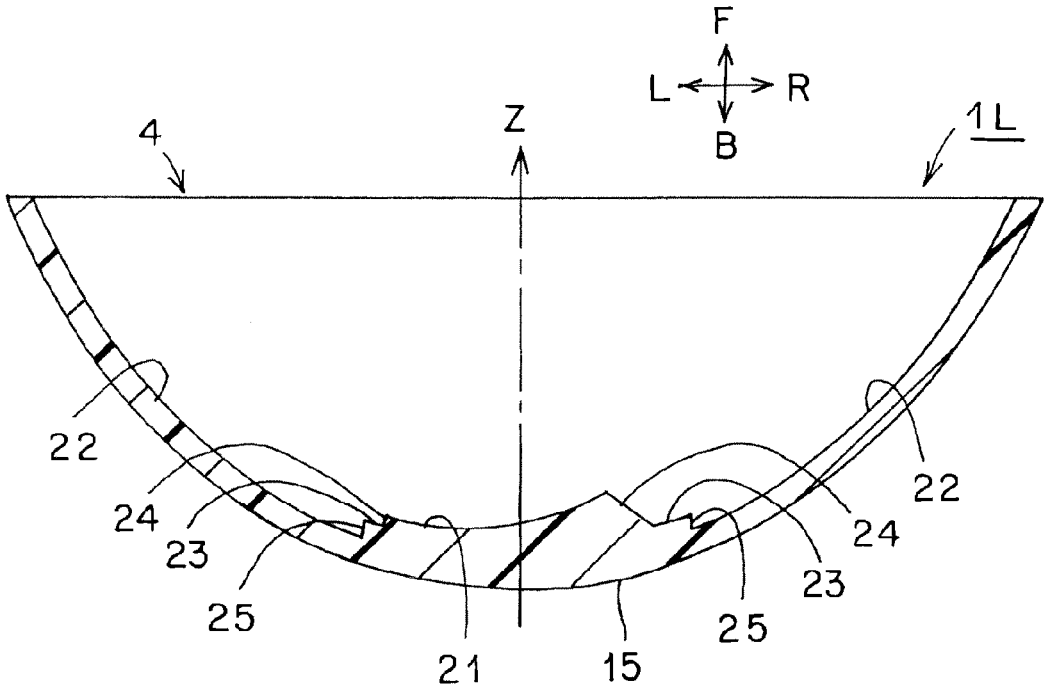
FIG. 7 is a sectional view taken along the line VII-VII in FIG. 4, the sectional view showing a first reflection surface, a second reflection surface, and a third reflection surface of a reflector.

The first reflection surface 21 is provided in proximity to the semiconductor-type light source 14. The first reflection surface 21 is a reflection surface adapted to reflect and emit incident light from among beams of the light from the semiconductor-type light source 14 as an auxiliary light distribution pattern, in this example, as the lateral light distribution patterns CPL and CPR (refer to FIG. 9 to FIG. 11). As shown in FIG. 7, as far as the first reflection surface 21 is concerned, the first reflection surface 21 outside of the vehicle C (on the right side R in the case of the vehicle headlamp 1L that is to be equipped on the left side L of the vehicle C or on the left side L in the case of the vehicle headlamp 1R that is to be equipped on the right side R of the vehicle C) is positioned on a back side B with respect to the first reflection surface 21 inside of the vehicle C (on the right side R in the case of the vehicle headlamp 1L that is to be equipped on the left side L of the vehicle C or on the left side L in the case of the vehicle headlamp 1R that is to be equipped on the right side R of the vehicle C). As far as an area of the first reflection surface 21 is concerned, the area of the outside of the vehicle C is larger than the area of the inside of the vehicle C. It is to be noted that the first reflection surface 21 is made of one continuous surface. However, the first reflection surface 21 may be made of a plurality of surfaces via a step height.

In FIG. 9 to FIG. 11, the lateral light distribution pattern for left side CPL that is to be emitted to the left side of the light distribution pattern for high beam HP and to the left side L of the light distribution pattern for low beam LP is an auxiliary light distribution pattern that is to be emitted from the first reflection surface 21 of the first lamp unit 4 of the vehicle headlamp 1L that is to be equipped on the left side L of the front portion of the vehicle C. The lateral light distribution pattern for right side CPR that is to be emitted to the right side P of the light distribution pattern for high beam HP and to the right side R of the light distribution pattern for low beam LP is an auxiliary light distribution pattern that is emitted from the first reflection surface 21 of the first lamp unit 4 of the vehicle headlamp 1R that is equipped on the right side R of the front portion of the vehicle C.

The lateral light distribution patterns CPL and CPR, as shown in FIG. 9 to FIG. 11, are those adapted to illuminate a respective one of the left and right sides L and R of the light distribution pattern for high beam HP and a respective one of the left and right sides L and R of the light distribution pattern for low beam LP, in other words, a shoulder edge 12 of a road surface on a cruising lane side and a shoulder edge 13 of a road surface on an opposite lane side. The lateral light distribution patterns CPL and CPR are not those which distort light distribution characteristics of the light distribution pattern for high beam HP and light distribution characteristics of the light distribution pattern for low beam LP.

The second reflection surface 22 is provided outside of the first reflection surface 21 in such a manner as to be spaced from the semiconductor-type light source 14. The second reflection surface 22 is a reflection surface adapted to reflect and emit the incident light from among beams of the light from the semiconductor-type light source 14 as the light distribution pattern for high beam HP.

The third reflection surface 23 is provided between the first reflection surface 21 and the second reflection surface 22. The third reflection surface 23 is a reflection surface adapted to reflect and emit the incident light from among beams of the light from the semiconductor-type light source 14 as an auxiliary light distribution pattern other than the lateral light distribution patterns CPL and CPR, in this example, as a light distribution pattern for overhead sign OSP (refer to FIG. 9) or a light distribution pattern for front side BP (refer to FIG. 10).

The light distribution pattern for overhead sign OSP, as shown in FIG. 9, is adapted to illuminate an overhead sign (not shown) on the upside U more than a cutoff line CL of the light distribution pattern for low beam LP, in other words, overhead of the vehicle C. In addition, the light distribution pattern for front side BP, as shown in FIG. 10, is adapted to illuminate a portion of the downside D of the light distribution pattern for low beam LP, in other words, the front side of a road surface. The light distribution pattern for overhead sign OSP and the light distribution pattern for front side BP are not those which disturb light distribution characteristics of the light distribution pattern for low beam LP.

Figure 4:
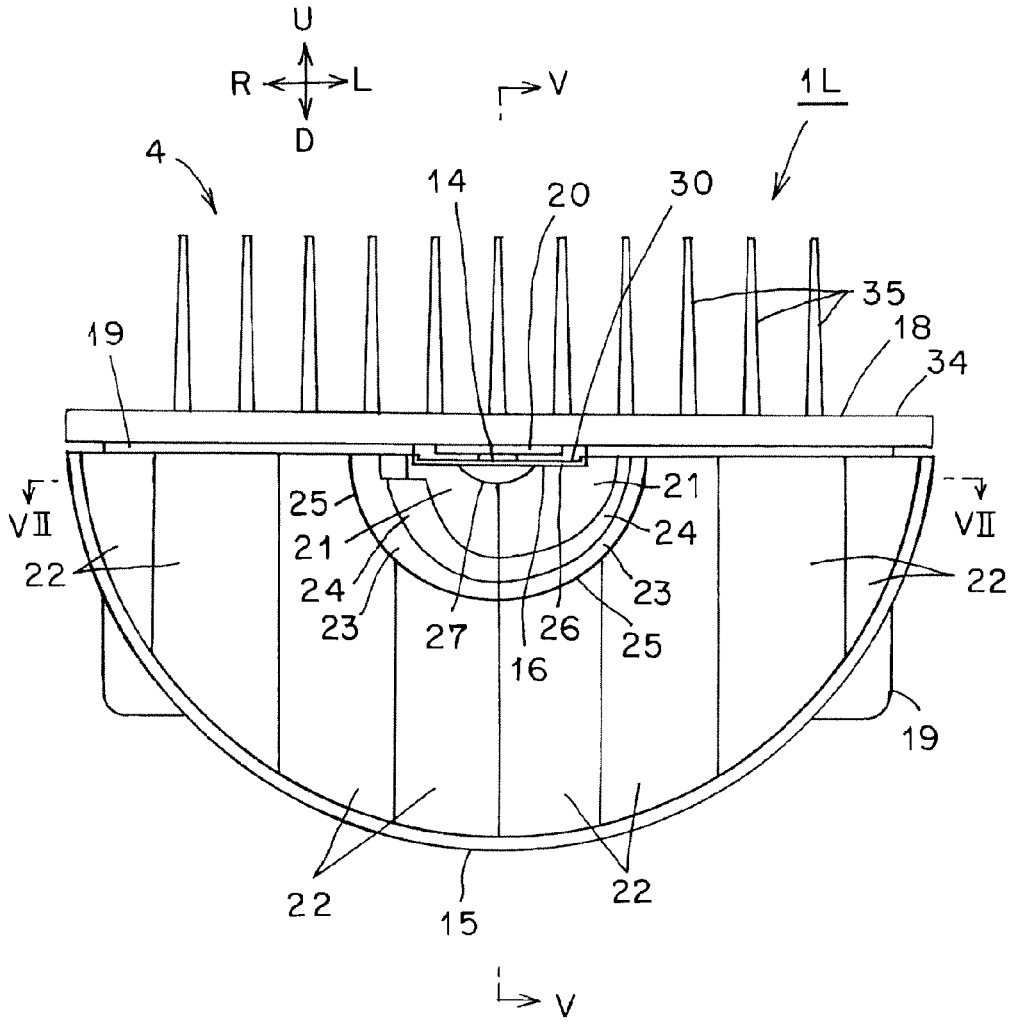
FIG. 4 is a front view showing the first lamp.

As shown in FIG. 4, the first reflection surface 21 and the third reflection surface 23, in this example, are made of two segments at the left and right, and the second reflection surface 22, in this example, is made of eight segments at the left and right. Step heights 24 and 25 are respectively provided between the second reflection surface 21 and the third reflection surface 23 and between the third reflection surface 23 and the second reflection surface 22.

The shade 16 is made of: a slide guide portion 26 that is formed in a recessed shape with a shallow bottom thereof; a shade portion 27 that is formed in a ¼ spherical shape that is integrally provided at one end part (a front side end part) of the slide guide portion 26; and a fixing portion 28 that is integrally provided at the other end part (a back side end part) of the slide guide portion 26. An opening portion is provided at an intermediate part of the slide guide portion 26, an opening portion 29.

A fixing guide portion 30 is provided on one surface (an upper surface) of the reflector 15 and on the mount bracket 19. On the fixing guide portion 30 of the reflector 15 and the mount bracket 19, the slide guide portion 26 of the shade 16 is mounted movably (slidably) in one direction (in a forward/backward direction). As a result, the shade 16 is disposed movably between a first location (a back side location shown in FIG. 5) and a second location (a front side position shown in FIG. 6). The first location, as shown in FIG. 5, is a location in which the third reflection surface 23 is disposed on a straight line that connects the semiconductor-type light source 14 and an edge (an opening edge) of the shade portion 27 of the shade 16 to each other.

When the shade 16 is positioned in the first location, a fraction of the light from the semiconductor-type light source 14 is shaded by means of the shade portion 27 of the shade 16 and then the remaining light is caused to be incident to the first reflection surface 21 and the second reflection surface 22. Alternatively, when the shade 16 is positioned in the second location, the light from the semiconductor-type light source 14 is caused to be incident to the first reflection surface 21 and the third reflection surface 23 and then is further caused to be incident to the second reflection surface 22.

The driving mechanism 17 is a solenoid in this example. The driving mechanism 17 is adapted to move and switch the shade 16 between the first location and the second location. The driving mechanism 17 is made of: a solenoid main body potion 31; and a plunger (an advancing and retracting rod) 32 that is provided retractably from the solenoid main body portion 31. The solenoid main body portion 31 of the driving mechanism 17 is mounted on at least one of the heat sink member 18 and the mount bracket 19. The plunger 32 of the driving mechanism 17 is mounted on the fixing portion 28 of the shade 16 via an L-shaped connecting member 33.

Figure 5:
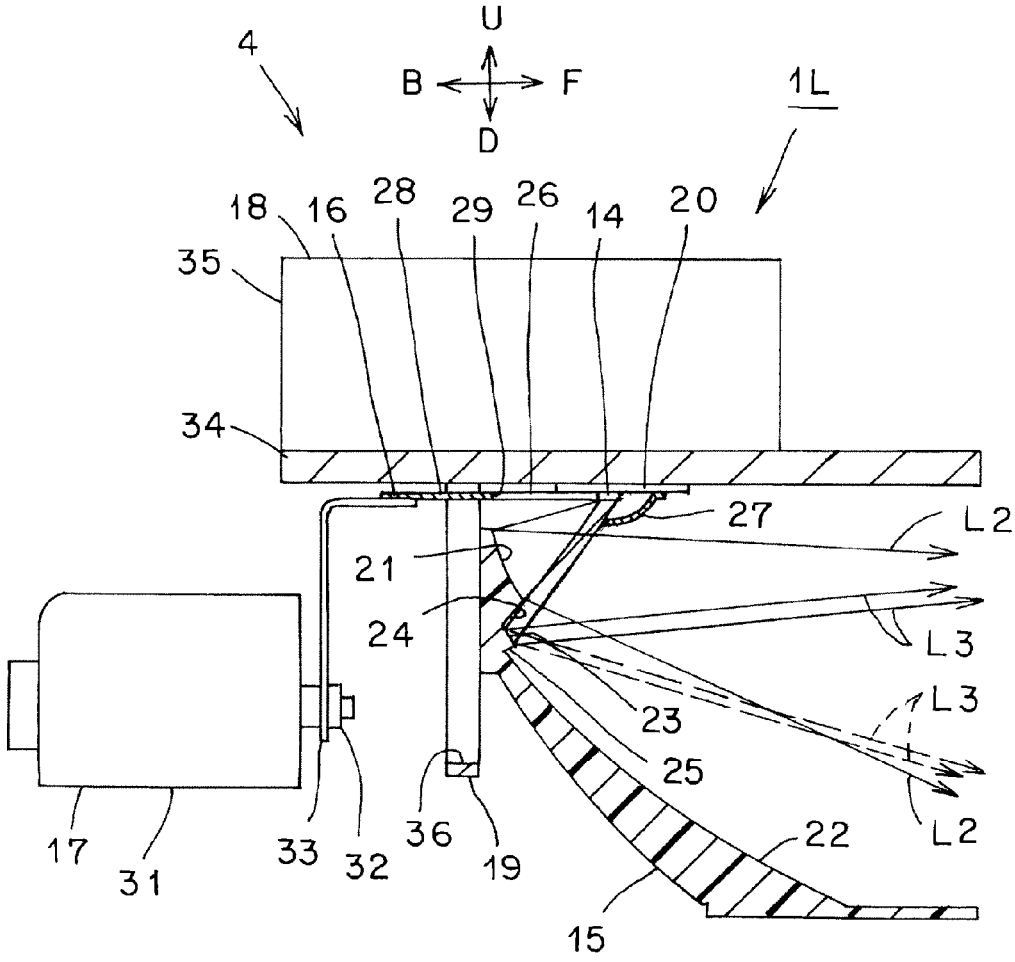
FIG. 5 is a sectional view taken along the line V-V in FIG. 4, the sectional view showing a state in which a shade is positioned in a first location.
Figure 6:
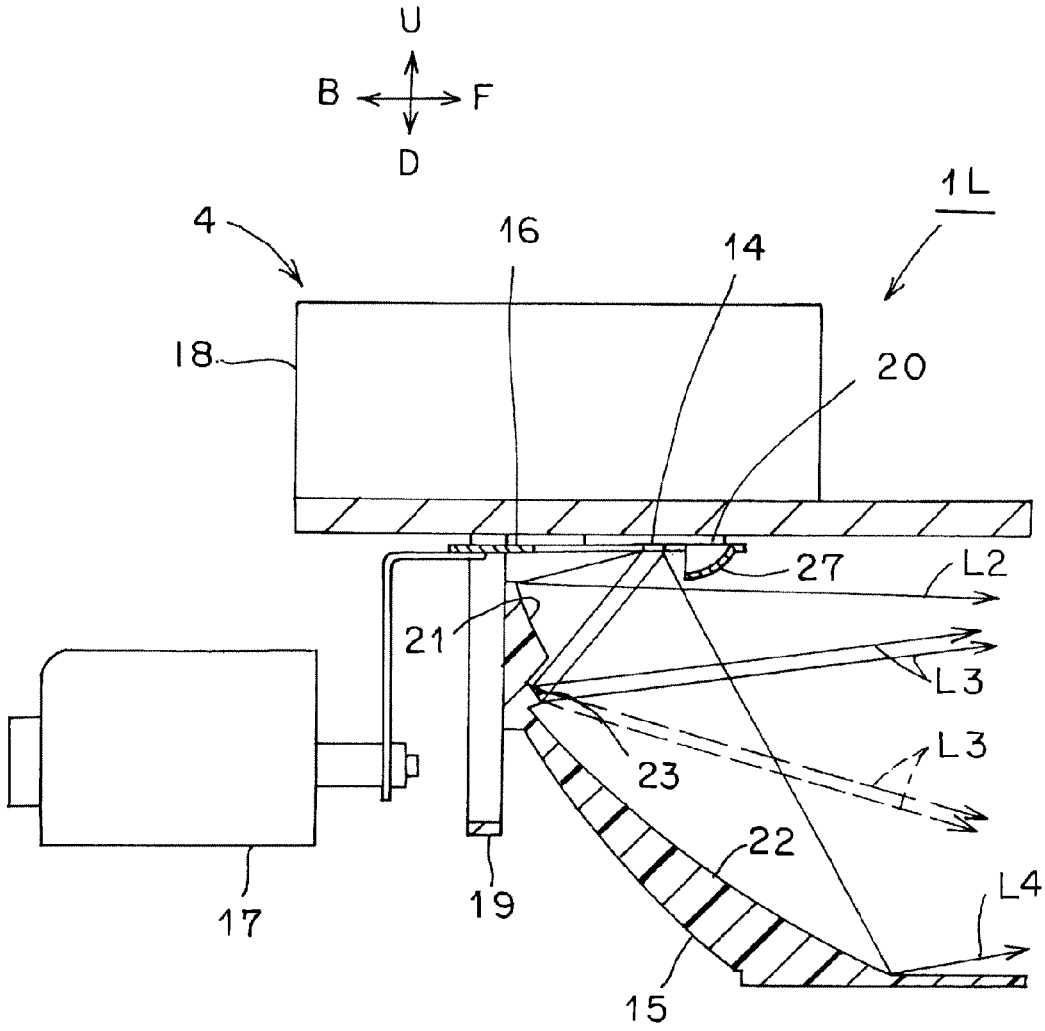
FIG. 6 is a sectional view taken along the line V-V in FIG. 4, the sectional view showing a state in which a shade is positioned in a second location.

When the driving mechanism 17 is established in a normal state, in other words, in a state in which no power is supplied to the solenoid main body portion 31, as shown in FIG. 5, this driving mechanism causes the shade 16 to be positioned in the first location by means of a spring, although not shown (a spring that is incorporated in the driving mechanism 17 or a spring that is provided separately). When power is supplied to the solenoid main body portion 31, as shown in FIG. 6, the plunger 32 advances against a spring force of the spring and then causes the shade 16 to move and switch from the first location to the second location. When power supply to the solenoid main body portion 31 is shaded, the plunger 32 is retracted by means of the spring force of the spring and then the shade 16 is caused to move and switch from the second location to the first location.

The heat sink member 18 is made of: a horizontal plate portion 34; and a fin portion 35 that is integrally provided on one surface (an upper surface) of the horizontal plate portion 34. On the other surface (a lower surface) of the horizontal plate portion 34 of the heat sink member 18, the semiconductor-type light source 14 is mounted via the mount member 20.

The mount bracket 19 is formed in the shape of a plate. A window portion 36 is provided at a center part of the mount bracket 19. The fixing guide portion 30 is provided at a center of one edge (an upper edge) of the window portion 36 of the mount bracket 19. One edge (the upper edge) of the mount bracket 19 is mounted on the other surface (the lower surface) of the horizontal plate portion 34 of the heat sink member 18. It is to be noted that the heat sink member 18 and the mount bracket 19 may be integrally structured.

Figure 8:
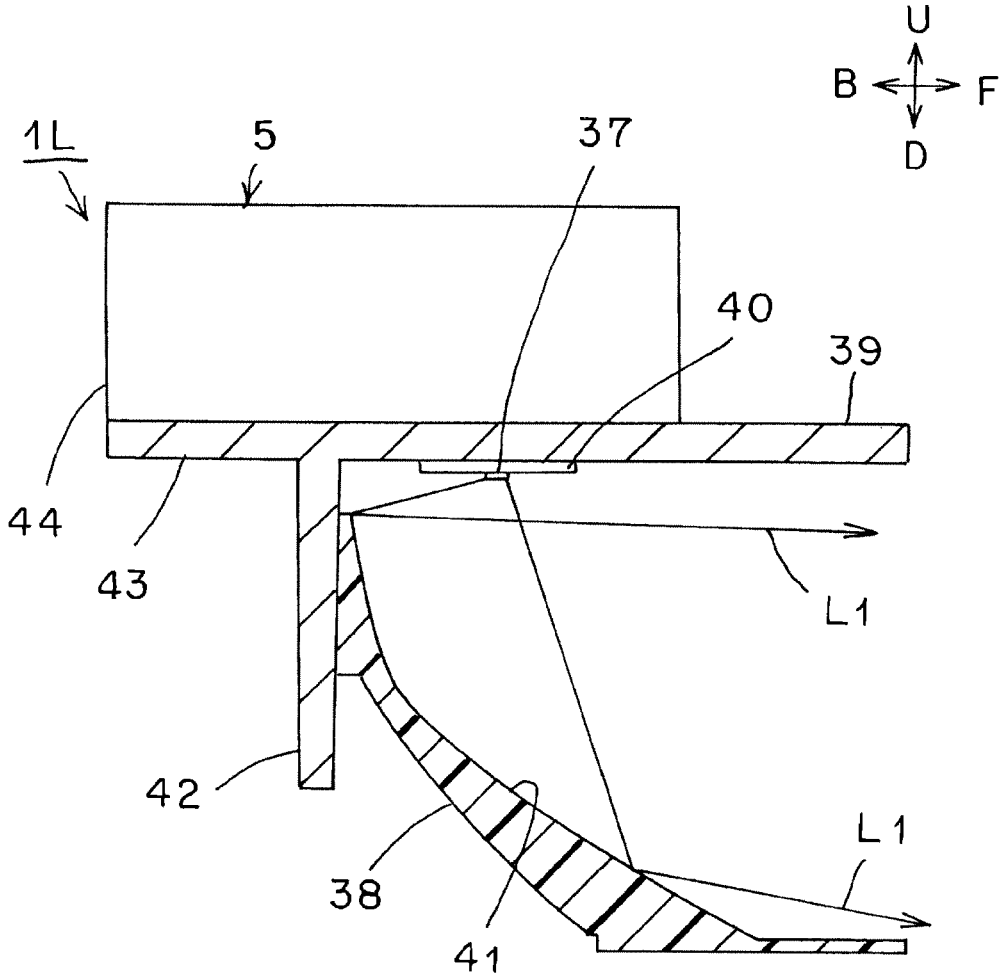
FIG. 8 is a sectional view taken along the line VIII-VIII in FIG. 2, the sectional view showing a second lamp unit.

The second lamp unit 5, as shown in FIG. 8, is provided with a semiconductor-type light source 37, a reflector 38, and a heat sink 39.

The semiconductor-type light source 37, in this example, uses its own light emitting semiconductor-type light source such as an LED or an EL (an organic EL), for example, in other words, a semiconductor-type light source (an LED in this exemplary embodiment). The semiconductor-type light source 37 has a light emitting portion in which one or a plurality of light emitting chips (not shown) is provided. The semiconductor-type light source 37 is made of: a board (not shown); the light emitting chips that are appropriately disposed and provided on the board; and a sealing resin member (not shown) adapted to seal the light emitting chips. The semiconductor light source 37 is mounted on the heat sink 39 by means of a mount member 40. A light emitting surface of the light emitting portion of the semiconductor light source 14 is oriented to the downside D in a vertical direction.

The reflector 38 is made of a light non-transmissible member, in this example, a resin member. The reflector 38 is mounted on the heat sink member 39. The reflector 38 is formed in a hollowed shape which opens at the upside and front side and which closes at the back side F, downside D, left wise L, and right side R. The closed portions at the back side B, downside D, left side L, and right side D are formed in the shape of a curved plate which is substantially ½ of a rotational parabolic shape.

A reflection surface 41 made of a parabola-based free curved surface (a NURBS-curved surface) is provided on an interior face of a respective one of the closed portions of the reflector 38. The reflection surface 41 is provided at an opposite side to the light emitting surface, in other words, in a space of the downside D of the semiconductor-type light source 37. The reflection surface 41 is a reflection surface adapted to reflect and emit the light from the semiconductor-type light source 37 as the light distribution pattern for low beam LP (refer to FIG. 9 and FIG. 10). The reflection surface 41 is made of eight segments at the left and right.

The heat sink member 39 is made of: a vertical plate portion 42; a horizontal plate portion 43; and a fin portion 44 that is integrally provided on one surface (the upper surface) of the horizontal plate portion 43. On the other surface (the lower surface) of the horizontal plate portion 43 of the heat sink member 39, the semiconductor-type light source 37 is mounted via the mount member 40. It is to be noted that the vertical plate portion 42 may be structured as a mount bracket in such a manner as to be separate from the horizontal plate portion 43 and the fin portion 44.

Description of Function of First Embodiment

The vehicle headlamps 1L and 1R in the first embodiment is made of the constituent elements as described above, and hereinafter, its related functions will be described.

First, a description of functions at the time of emission of a light distribution pattern for low beam LP will be given. At this time, a solenoid main body portion 31 is established in a no-power supply state. Thus, a shade 16 of a first lamp unit 4 is positioned in a first location. At this time, a semiconductor-type light source 37 of a second lamp unit 5 is lit. Then, the light that is radiated from the semiconductor-type light source 37 is reflected on a reflection surface 41, as shown in FIG. 8. The reflected light L1 is emitted forward (to a front side F) of a vehicle C as a light distribution pattern low beam LP (refer to FIG. 9 and FIG. 10).

A semiconductor-type light source 14 of the first lamp unit 4 is lit at the same time as when the semiconductor-type light source 37 of the second lamp unit 5 is lit. Then, as shown in FIG. 5, a fraction of the light that is radiated from the semiconductor-type light source 14 is shaded by means of a shade portion 27 of the shade 16 that is positioned in the first location. The remaining light that is not shaded is reflected on a first reflection surface 21 and a third reflection surface 23.

Having thus reflected on the first reflection surface 21, the reflected light L2 is emitted forward of the vehicle C as lateral light distribution patterns CPL and CPR on both of the left and right sides of an auxiliary light distribution pattern (refer to FIG. 9 and FIG. 10). In other words, as the lateral light distribution pattern for left side CPL, the reflected light L2 from the first reflection surface 21 of the first lamp unit 4 of a vehicle headlamp 1L that is to be equipped on the left side L of the front portion of the vehicle C is emitted to the left side L of the light distribution pattern for low beam LP. On the other hand, as the lateral light distribution pattern for right side CPR, the reflected light L2 from the first reflection surface 21 of the first lamp unit 4 of a vehicle head lamp 1R that is to be equipped on the right side R of the vehicle C is emitted to the right side R of the light distribution pattern for low beam LP.

Having thus reflected on the third reflection surface 23, the reflected light L3, as indicated by the line arrow drawn with the solid line in FIG. 5, is emitted forward of the vehicle C as a light distribution pattern for overhead sign OSP (refer to FIG. 9) of an auxiliary light distribution pattern other than the lateral light distribution patterns CPL and CPR. Alternatively, the reflected light L3 having reflected on the third light distribution pattern 23, as indicated by the arrow drawn with the dashed line in FIG. 5, is emitted forward of the vehicle C as a light distribution pattern for front side BP (refer to FIG. 10).

In this way, by means of a second lamp unit 5, a road surface in front (front side F) of the vehicle C, in other words, a cruising lane 10 and an opposite lane 11 are illuminated with the light distribution pattern for low beam LP. In addition, by means of the first reflection surface 21 of the first lamp unit 4, the road surfaces on the front side of the vehicle C, in other words, a shoulder edge 12 on a road surface on the cruising lane side and a shoulder edge 13 of a road surface on the opposite lane side are illuminated with the lateral light distribution patterns for both of the left side and right side CPL and CPR of auxiliary light distribution patterns. Further, by means of the third reflection surface 23 of the first lamp unit 4, an overhead sign (not shown) that is provided overhead on the front side of the vehicle C is illuminated with the light distribution pattern for overhead sign OSP (refer to FIG. 9) of an auxiliary light distribution pattern other than the lateral light distribution patterns CPL and CPR, or alternatively, the road surface on the front side of the vehicle C, in other words, the road surface on the front side is illuminated with a light distribution pattern for front side BP (refer to FIG. 10). It is to be noted that in FIG. 9, another light distribution pattern for overhead sign (not shown) may be further optically distributed between a cutoff line CL of the light distribution pattern for low beam LP and a light distribution pattern for overhead sign OSP of an auxiliary light distribution pattern as well.

Next, a description of functions at the time of emission of a light distribution pattern for high beam HP will be given. At this time, the semiconductor-type light source 37 of the second lamp unit 5 is lit, whereas the semiconductor-type light source 14 of the first lamp unit 4 is lit, and power is supplied to the solenoid main body portion 31. Then, the shade 16 that is positioned in the first location moves and switches to a second location, so that the light having been shaded by means of a shade portion 27 of the shade 16 up to now is incident to, and is reflected on, the second reflection surface 22.

Having thus reflected on the second reflection surface 22, the reflected light L4 is emitted forward of the vehicle C as a light distribution pattern for high beam HP, as shown in FIG. 11. At this time, the light from the semiconductor-type light source 14 of the first lamp unit 4 is incident to, and is reflected on, the first reflection surface 21 and the third reflection surface 23 as well. Thus, the lateral light distribution patterns for both of the left side and right side CPL and CPR of the auxiliary light distribution patterns that are obtained by means of the reflected light L2 (refer to FIG. 6) are emitted to both of the left and right sides L and R of the light distribution pattern for high beam HP. In addition, the light distribution pattern for overhead sign OSP of an auxiliary light distribution pattern other than the lateral light distribution patterns CPL and CPR that are obtained by means of the reflected light L3 (refer to the arrow drawn with the solid line in FIG. 6), or alternatively, the light distribution pattern for front side BP that is obtained by means of the reflected light L3 (refer to the arrow drawn with the dashed line in FIG. 6), are emitted to the upside U or downside D of the light distribution pattern for high beam HP. On the other hand, the light distribution pattern for low beam LP from the second lamp unit 5 is emitted to half of the downside D of the light distribution pattern for high beam HP. In other words, the light distribution pattern that is emitted from the first lamp unit 4 and the light distribution pattern that is emitted from the second lamp unit 5 are combined with each other and then a light distribution pattern for high beam is formed. The light distribution pattern for low beam LP and the light distribution pattern for overhead sign OSP or the light distribution pattern for front side BP are not shown in FIG. 11 because these patterns are included in the light distribution pattern for high beam HP. It is to be noted that part or all of the light distribution patterns for overhead sign OSP may be optically distributed at a slight upside (upper side) more than that of the light distribution pattern for high beam HP as well.

Description of Advantageous Effects of First Embodiment

The vehicle headlamps 1L and 1R in the first embodiment are made of the constituent elements and functions as described above, and hereinafter, its related advantageous effects will be described.

The vehicle headlamps 1L and 1R in the first embodiment 1 are adapted to emit the light distribution patterns for both of the left side and right side CPL and CPR of the auxiliary light distribution patterns on the first reflection surface 21 of the first lamp unit 4 and to emit the light distribution pattern for high beam HP on the second reflection surface 22; and therefore, in comparison with the conventional vehicle headlamp in which only a light distribution pattern for DTL (an auxiliary light distribution pattern) can be obtained in a state in which a light distribution pattern for cruising is scattered, an arbitrary auxiliary light distribution pattern can be obtained by way of a design of the first reflection surface 21. For example, an arbitrary auxiliary light distribution pattern such as a light distribution pattern for spot or a light distribution pattern for scattering other than the lateral light distribution patterns CPL and CPR can be obtained. Moreover, the vehicle headlamps 1L and 1R in the first embodiment are capable of emitting an auxiliary light distribution pattern (an arbitrary auxiliary light distribution pattern such as a light distribution pattern for spot or a light distribution pattern for scattering other than the lateral light distribution patterns CPL and CPR) to thereby effectively utilize the first lamp unit 4 of the light distribution pattern for high beam HP that is not always emitted.

The vehicle headlamps 1L and 1R in the first embodiment are provided in such a manner that a light distribution pattern OSP or a light distribution pattern for front side BP of auxiliary light distribution patterns other than the lateral light distribution patterns for both of the left side and right side CPL and CPR of the auxiliary light distribution patterns that are obtained by means of the first reflection surface 21 is emitted by means of the third reflection surface 23 between the first reflection surface 21 and the second reflection surface 22, so that a plurality of auxiliary light distribution patterns can be obtained. As a result, the vehicle headlamps 1L and 1R in the first embodiment improves a degree of freedom in light distribution design of an auxiliary light distribution pattern.

Moreover, the vehicle headlamps 1L and 1R in the first embodiment are provided in such a manner that the third reflection surface 23 is provided between the first reflection surface 21 and the second reflection surface 22; and therefore, in a case where an allowable tolerance is set in precision of a stop position of the shade 16, when the shade 16 is positioned in the first location, even if the light from the semiconductor-type light source 14 leaks from the side of the first reflection surface 21 to the side of the second reflection surface 22, such light leakage can be effectively utilized as a light distribution pattern for overhead sign OSP or a light distribution pattern for front side BP of predetermined light distribution patterns, by means of the third reflection surface 23 for buffering (for light buffering) that is provided between the first reflection surface 21 and the second reflection surface 22. In other words, according to the vehicle headlamps 1L and 1R in the second aspect of the present invention, when the shade 16 is positioned in the first location, even if the light from the semiconductor-type light source 14, having leaked due to displacement of the shade 16, is incident to the second reflection surface 22 as it is, it is possible to reliably prevent the incident light from being troublesome light at the time of emission of a light distribution pattern for low beam LP.

The vehicle headlamps 1L and 1R according to a third aspect of the present invention are provided in such a manner that as far as the first reflection surface 21 is concerned, the first reflection surface 21 outside of a vehicle C is positioned at a back side B with respect to the first reflection surface 21 inside of the vehicle, thus making it easy to optically distributing an auxiliary light distribution pattern that is obtained by means of the first reflection surface 21 in such a manner as to be turned lateral of a light distribution pattern for low beam LP or a light distribution pattern for high beam HP. As a result, the vehicle headlamps 1L and 1R according to the first aspect of the present invention are optimal for lateral light distribution patterns CPL and CPR that is to be optically distributed by turning the auxiliary light distribution pattern that is obtained by means of the first reflection surface 21, lateral of the light distribution pattern for low beam LP or the light distribution pattern for high beam HP, and moreover, a light distribution design of the lateral light distribution patterns CPL and CPR is facilitated.

Furthermore, the vehicle headlamps 1L and 1R in the first embodiment are further optimal for the lateral light distribution patterns CPL and CPR because as far as an area of the first reflection surface 21 is concerned, an area of the outside of the vehicle C is larger than an area of the inside of the vehicle headlamp C, and moreover, a light distribution design of the lateral light distribution patterns CPL and CPR is further facilitated.

The vehicle headlamps 1L and 1R according to a fourth aspect of the present invention are provided in such a manner that: a lateral light distribution pattern from the first lamp unit 4 that is equipped on the left side L of a front portion of a vehicle C is emitted to the left side L of a light distribution pattern for high beam HP and to the left side L of a light distribution pattern for low beam LP; and a lateral light distribution pattern for right side from the first lamp unit 4 that is equipped on the right side R of the front portion of the vehicle C is emitted to the right side R of the light distribution pattern for high beam HP and to the right side R of the light distribution pattern for low beam LP. As a result, the vehicle headlamps 1L and 1R in the present invention is capable of emitting lateral light distribution patterns for both of the left side and the right side CPL and CPR without being shaded by parts of the vehicle headlamps 1L and 1R or parts of the vehicle C or the like, thus making it possible to effectively utilize the light that is radiated from a semiconductor-type light source 14.

Description of Second Embodiment

Figure 12:
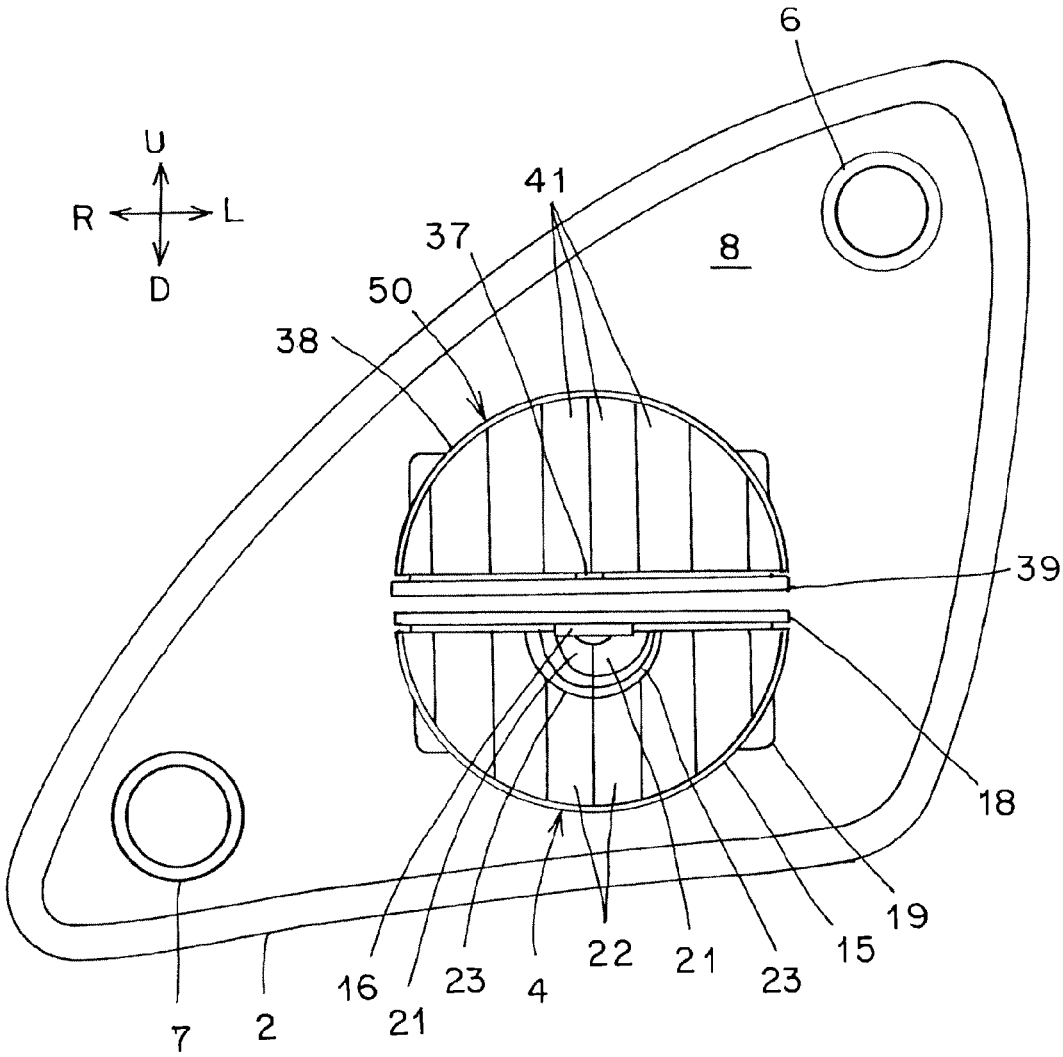
FIG. 12 is a front view of a vehicle headlamp in a state in which a lamp lens is removed, the front view showing a second embodiment of the vehicle headlamp according to the present invention.

FIG. 12 shows a second embodiment of a vehicle headlamp according to the present invention. Hereinafter, the vehicle headlamp in the second embodiment will be described. In the figure, like constituent elements in FIG. 1 to FIG. 11 are designated by like reference numerals.

The vehicle headlamps 1L and 1R of the first embodiment as described previously are provided in such a manner that the first lamp unit 4 are disposed inside of the vehicle C with respect to the second lamp unit 5 (on a right side R in the case of the vehicle headlamp 1L to be equipped on the left side L of the vehicle C and on the left side in the case of the vehicle headlamp 1R to be equipped on the right side R of the vehicle). The vehicle headlamp in the second embodiment is provided in such a manner that a first lamp unit 4 is disposed on a downside D of a vehicle C with respect to a second lamp unit 50.

The second lamp unit 50 of a respective one of the vehicle headlamps in the second embodiment forms a structure in which the second lamp unit 5 (refer to FIG. 2 and FIG. 8) of a respective one of the vehicle headlamps 1L and 1R in the first embodiment as described previously is reversed from its top and bottom.

The vehicle headlamps in the second embodiment are capable of achieving the functions and advantageous effects that are substantially identical to those of the vehicle headlamps 1L and 1R in the first embodiment 1 as described previously. In particular, the vehicle headlamps of the second embodiment are suitable for use in a case in which the space in a lamp room 8 is large in a vertical direction and is small in a horizontal direction because the first lamp unit 4 and the second lamp unit 50 are disposed on top and bottom.

Description of Examples Other than the First and Second Embodiments

In the first and second embodiments, lamp units of reflection type (reflector type) of which the semiconductor-type light source 37 is employed as a light source are used as the second lamp units 5 and 50. In the present invention, however, as the second lamp unit, there may be used a lamp unit other than the lamp unit of reflection type (reflector type) of which a semiconductor-type light source is employed as a light source. For example, there may be used a light source of bulb type such as a power discharge lamp, a halogen lamp, or an incandescent lamp as a light source. Alternatively, as a lamp unit, there may be used a lamp unit of reflection type (reflector type), a lamp unit of projection type (projector type), or a lamp unit of direct emission type. In other words, as the second lamp unit, a lamp unit adapted to emit a light distribution pattern for low beam will suffice.

In addition, in the first and second embodiments, a solenoid is used as a driving mechanism 17. In the present invention, however, as the driving mechanism 17, there may be used a driving mechanism other than the solenoid, for example, a driving mechanism such as a motor.

What is claimed is:

1. A vehicle headlamp comprising:

a first lamp unit adapted to switch and emit an auxiliary light distribution pattern and a light distribution pattern for a high beam; and a second lamp unit adapted to emit a light distribution pattern for a low beam, wherein the first lamp unit comprises:

a semiconductor-type light source:

a reflector having a first reflection surface and a second reflection surface;

a shade that is disposed to be movable between a first location and a second location, and that is adapted to:

shade a fraction of light from the semiconductor-type light source and to cause residual light to be incident to the first reflection surface, when the shade is positioned in the first location, and cause the light from the semiconductor-type light source to be incident to the first reflection surface and the second reflection surface, when the shade is positioned in the second location; and a driving mechanism adapted to move and switch the shade between the first location and the second location, wherein the first reflection surface is a reflection surface that is provided in proximity to the semiconductor-type light source, the reflection surface being adapted to reflect and emit incident light from among beams of the light from the semiconductor-type light source as the auxiliary light distribution pattern, and the second reflection surface is a reflection surface that is provided outside of the first reflection surface so as to be spaced from the semiconductor-type light source, the reflection surface being adapted to reflect and emit incident light from among beams of the light from the semiconductor-type light source as the light distribution pattern for the high beam.

2. The vehicle headlamp according to claim 1, wherein a third reflection surface is provided between the first reflection surface and the second reflection surface, and the third reflection surface is a reflection surface that is adapted to reflect and emit incident light from the light from among beams of the semiconductor-type light source as another auxiliary light distribution pattern that is not the auxiliary light distribution pattern.

3. The vehicle headlamp according to claim 1, wherein the first reflection surface has a portion outside of a vehicle that is configured to be positioned at a back side with respect to a portion of the first reflection surface inside of the vehicle.

4. The vehicle headlamp according to claim 1, wherein the auxiliary light distribution pattern that is emitted from the first reflection surface of the first lamp unit that is equipped on a left side of a front portion of a vehicle is a lateral light distribution pattern that is emitted to a left side of the light distribution pattern for the high beam that is emitted from the second reflection surface and to a left side of a light distribution pattern for the low beam that is emitted from the second lamp unit, and the auxiliary light distribution pattern that is emitted from the first reflection surface of the first lamp unit that is equipped on a right side of the front portion of the vehicle is a lateral light distribution pattern that is emitted to a right side of the light distribution pattern for the high beam that is emitted from the second reflection surface and to a right side of a light distribution pattern for the low beam that is emitted from the second lamp unit.

5. The vehicle headlamp according to claim 1, wherein the reflector is mounted by a mount bracket that is perpendicular to the reflector in a vehicle vertical direction, and wherein the shade is configured to be slidably movable in an approximately parallel direction to the semiconductor-type light source between the first location and the second location in a direction perpendicular to the mount bracket.

6. The vehicle headlamp according to claim 1, wherein the second lamp unit is not provided with the shade that is slidably movable.

* * * * *